US009915405B2

(12) United States Patent
Maier et al.

(10) Patent No.: US 9,915,405 B2
(45) Date of Patent: Mar. 13, 2018

(54) LIGHTING DEVICE FOR A MOTOR VEHICLE HEADLIGHT

(71) Applicant: ZIZALA LICHTSYSTEME GMBH, Wieselburg (AT)

(72) Inventors: Udo Maier, Herzogenburg (AT); Lukas Taudt, Ferschnitz (AT); Oliver Reittegger, Groebming (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 105 days.

(21) Appl. No.: 15/032,706

(22) PCT Filed: Oct. 27, 2014

(86) PCT No.: PCT/AT2014/050259

§ 371 (c)(1),
(2) Date: Apr. 28, 2016

(87) PCT Pub. No.: WO2015/061822

PCT Pub. Date: May 7, 2015

(65) Prior Publication Data

US 2016/0273727 A1 Sep. 22, 2016

(30) Foreign Application Priority Data

Oct. 28, 2013 (AT) ..... A 50703/2013

(51) Int. Cl.
*F21S 8/10* (2006.01)

(52) U.S. Cl.
CPC ..... *F21S 48/125* (2013.01); *F21S 48/1154* (2013.01); *F21S 48/1241* (2013.01); *F21S 48/145* (2013.01); *F21S 48/1747* (2013.01)

(58) Field of Classification Search
CPC ..... F21S 48/1241; F21S 48/145
(Continued)

(56) References Cited

U.S. PATENT DOCUMENTS

2008/0013333 A1* 1/2008 Koizumi ..... B60Q 1/2696 362/511
2014/0204602 A1* 7/2014 Jungwirth ..... F21S 48/1154 362/521

(Continued)

*Primary Examiner* — Christopher Raabe
(74) *Attorney, Agent, or Firm* — Eversheds Sutherland (US) LLP

(57) ABSTRACT

The invention relates to a lighting device (500) for a motor vehicle headlight, wherein the lighting device comprises at least one optical body (1) and at least one mounting device (100) for the at least one optical body (1), wherein the at least one optical body (1) has a number of adjacently arranged ancillary optics (11, 12, 13, 14, 15), wherein each ancillary optics (11-15) is formed from a light-guiding material and each ancillary optics (11-15) has a light-coupling face (11*a*-15*a*) and a light-decoupling face (11*b*-15*b*), wherein the at least one mounting device (100) has at least one receptacle (111, 112, 113, 114, 115) for each ancillary optics (11-15), and wherein receptacles (111-115) are delimited by delimiting walls (111', 112', 113', 114', 115'), wherein the delimiting walls (111', 112', 113', 114', 115') have boundary edges (111*a'*, 112*a'*, 113*a'*, 114*a'*, 115*a'*) on the light exit side, which boundary edges (111*a'*, 112*a'*, 113*a'*, 114*a'*, 115*a'*) are imaged, in a light distribution produced by means of the at least one optical body (1), as light-dark edges between the partial light distributions produced by the individual ancillary optics (11-15), and wherein a projection arrangement, preferably a projection lens (501), is arranged downstream of the at least one optical body (1) in the light exit direction, and wherein the ancillary optics (11-15) are arranged and/or configured in such a way that the light-decoupling faces (11*b*-15*b*) of the ancillary optics (11-15) protrude in the light exit direction beyond the boundary edges (111*a'*, 112*a'*, 113*a'*, 114*a'*, 115*a'*) of the delimiting walls (111', 112', 113', 114', 115').

20 Claims, 3 Drawing Sheets

Figure 1:
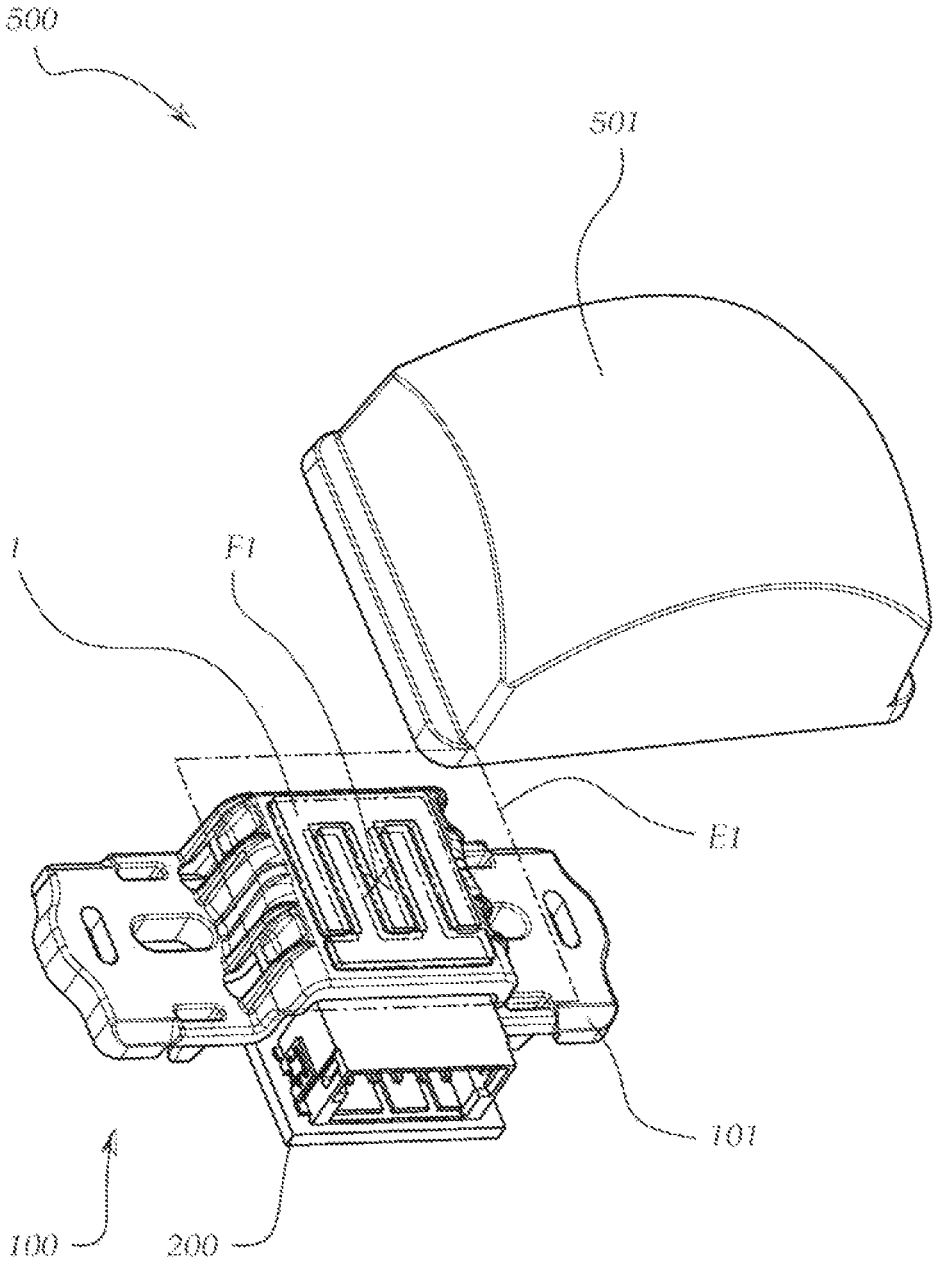

(58) Field of Classification Search
USPC ..... 362/511
See application file for complete search history.

(56) References Cited

U.S. PATENT DOCUMENTS

2015/0085523 A1* 3/2015 Gurtl ..... F21S 48/1154
362/607
2015/0124469 A1* 5/2015 Krenn ..... F21S 48/1154
362/511

* cited by examiner

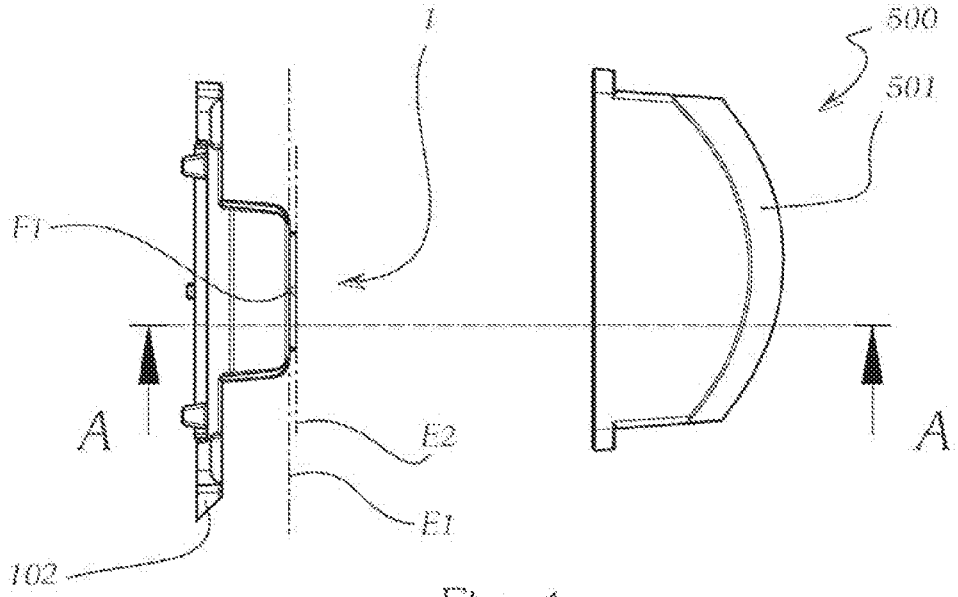
Fig. 4
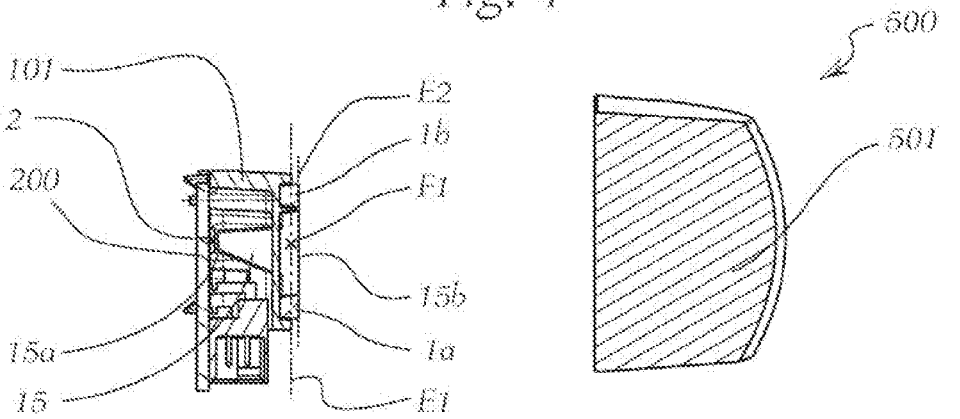
Fig. 5
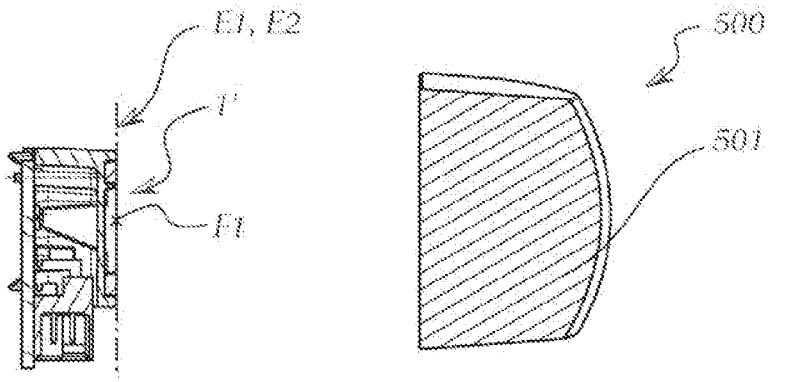
Fig. 6 (Stand der Technik)

LIGHTING DEVICE FOR A MOTOR VEHICLE HEADLIGHT

The invention relates to a lighting device for a motor vehicle headlight, wherein the lighting device comprises at least one optical body and at least one mounting device for the least one optical body, wherein the at least one optical body has a number of adjacently arranged ancillary optics, wherein each ancillary optics is formed from a light-guiding material and each ancillary optics has a light-coupling face and a light-decoupling face, wherein the at least one mounting device has at least one receptacle for each ancillary optics, and wherein receptacles are delimited by delimiting walls, wherein the delimiting walls have boundary edges on the light exit side, which boundary edges are imaged, in a light distribution produced by means of the at least one optical body, as light-dark edges between the partial light distributions produced by the individual ancillary optics, and wherein a projection arrangement, preferably a projection lens, is arranged downstream of the least one optical body in the light exit direction.

The invention also relates to a light module for a motor vehicle headlight, comprising at least one such lighting device.

In addition, the invention also relates to a motor vehicle headlight comprising one or more light modules of this type.

Optical bodies of the type mentioned in the introduction are used in light modules for motor vehicle headlights in order to produce light distributions, for example in order to produce segmented lights distributions, i.e. light distributions which are constructed from individual light segments. The ancillary optics are generally manufactured from plastic, silicone, glass, etc. In order to meet the requirements in terms of light, i.e. in particular the legal stipulations and the stipulations of car manufacturers, and also in order to withstand the mechanical stresses for as long as possible, preferably over the service life of the vehicle, it is necessary for the optical bodies to be fixed accurately and in a stable manner in this desired position.

In order to define the individual light segments it is necessary to delimit these relatively sharply, in particular laterally. For this purpose, the individual ancillary optics of the optical body are delimited at least laterally by delimiting walls, wherein these delimiting walls are formed from a light-impermeable material.

The light-decoupling faces of the ancillary optics and the light exit-side boundary edges of the delimiting walls lie in a common plane, wherein this plane can be flat or curved. The focal point of a projection lens arranged downstream of the optical body, which projection lens images the light distribution into a region in front of the vehicle, lies here in this common plane, such that the boundary edges of the delimiting walls are imaged as sharply as necessary in the light pattern and the light segments are therefore sharply delimited accordingly.

However, it has been found that dust deposits often form on the light exit faces of the ancillary optics, which dust deposits are visible in the light distribution or in the individual light segments as dark flecks and disturb the homogeneity of the light distribution or the light segments, which is undesirable.

The object of the invention is to overcome this problem.

This object is achieved with an ancillary optics system as mentioned in the introduction in that, in accordance with the invention, the ancillary optics are arranged and/or configured in such a way that the light-decoupling faces of the ancillary optics protrude beyond the boundary edges of the delimiting walls in the light exit direction.

Due to the protruding arrangement of the light-decoupling faces with respect to the boundary edges, the boundary edges, which are still arranged in a plane containing the focal point of the downstream projection lens, are still imaged sharply, whereas the light-decoupling faces are imaged in a defocussed manner and accordingly are imaged in a blurred manner. For the light distribution within the individual light segments, this blurred imaging is irrelevant, since a homogeneous light distribution is what matters here, whereas the delimitation of the light segments is still imaged sharply. Due to the defocussing of the light-decoupling faces, however, any dust deposits are also imaged in a defocussed manner and accordingly can no longer be identified and no longer disturb the homogeneity of the light distribution.

As already mentioned above, the boundary edges lie in a common plane, wherein this plane is preferably continuous, in particular at least C0 continuous.

The common plane of the boundary edges is typically flat and is preferably arranged approximately normal to the light exit direction.

The light-decoupling faces are curved and/or are arranged along a curved bend, for example in order to follow a field of view curvature of the lens. However, the light-decoupling faces of the ancillary optics are preferably flat.

It is also preferable when the light-decoupling faces of the ancillary optics lie in a common plane.

It is also advantageous when the common plane of the light-decoupling faces is arranged at a constant distance from the common plane of the boundary edges.

The light-decoupling faces are therefore arranged throughout at the same normal distance from the plane through the boundary edges of the delimiting walls, and therefore extend in parallel.

As also already mentioned above, it is advantageous when the common plane of the boundary edges lies in a focal point of the projection lens or contains this. In this way, the boundary edges are imaged sharply in the light pattern.

Is also expedient when the ancillary optics bear directly, i.e. with no distance, against the delimiting walls of their at least one receptacle so as to obtain an optimal optical display of the light segments.

Here, delimiting walls are provided at least between the adjacently arranged receptacles.

However, it is particularly preferred when the two outer receptacles are also each delimited at their outer side by delimiting walls.

In accordance with a specific embodiment of the invention adjacently arranged receptacles are separated in each case by a common separation web, which webs form the delimiting walls for the adjacent receptacles.

In order to fasten the least one optical body in the desired position relative to light sources, which feed light to the ancillary optics, the mounting device for the optical body can be connected to a support for the one or more light sources, which is/are provided in order to radiate light into the ancillary optics of the optical body.

In a specific embodiment of the invention relevant in practice, the position of the boundary edges relative to the at least one light source is fixed, and the optical body is lengthened in the light exit direction compared with an optical body of which the light exit faces lie in a common plane with the boundary edges.

The effects according to the invention can thus be achieved even in existing support-mounting device systems merely by modification of the optical body.

In accordance with a specific embodiment the mounting device comprises a main body, which can be connected to the support for the one or more light sources for feeding light into the optical body.

The receptacles for the ancillary optics are then preferably formed in the main body.

The optical body is held in the main body by means of a retaining body, which presses the optical body into the main body formed suitably for this purpose and holds the optical body in the desired position in a stable manner following connection of the retaining body to the main body.

In accordance with a specific embodiment of the invention the ancillary optics are mechanically interconnected in the region of the light-decoupling faces by means of at least one connecting web extending transversely to the ancillary optics, wherein the at least one connecting web is optically ineffective at least in regions, and wherein the main body also has at least one stop region, against which the optical body can be brought into abutment via a rear face of the at least one connecting web when the ancillary optics are inserted into the at least one receptacle.

In order to produce a segmented light distribution, it is advantageous when the light-decoupling faces of adjacent ancillary optics are arranged at a distance a>0 from one another.

For manufacturing reasons it may also be advantageous if the optical body consists of at least two separate optical components, wherein each optical component comprises at least one light-guiding body.

It is particularly expedient if the optical element consists of precisely two optical components, wherein it is then preferable if at least one, preferably all optical components comprises/comprise two or more light-guiding bodies.

Figure 2:
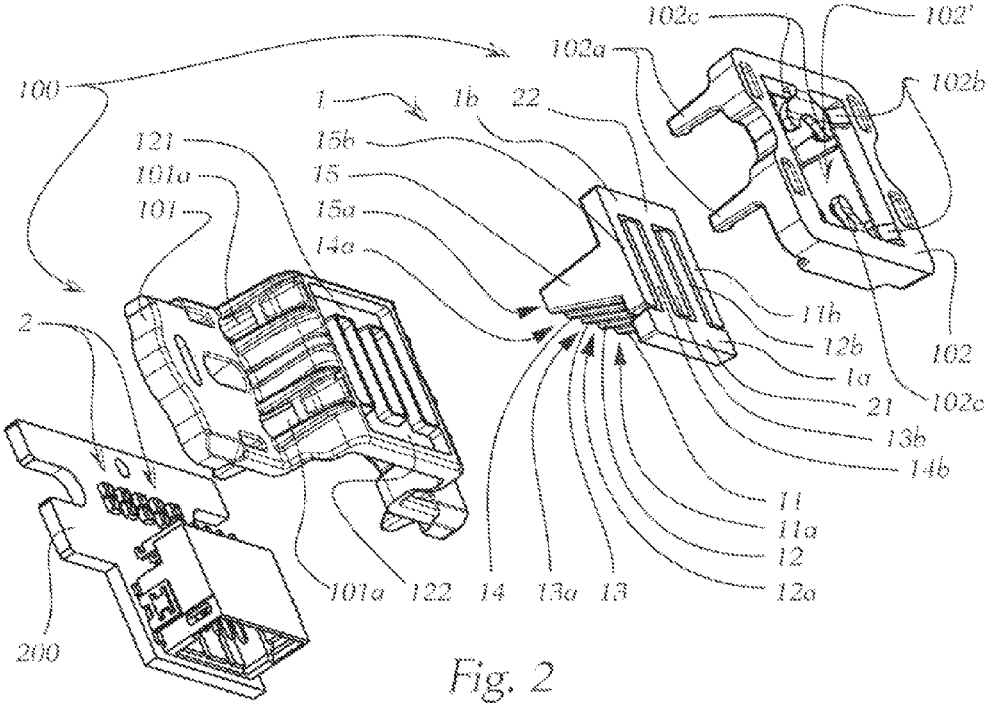
Figure 3:
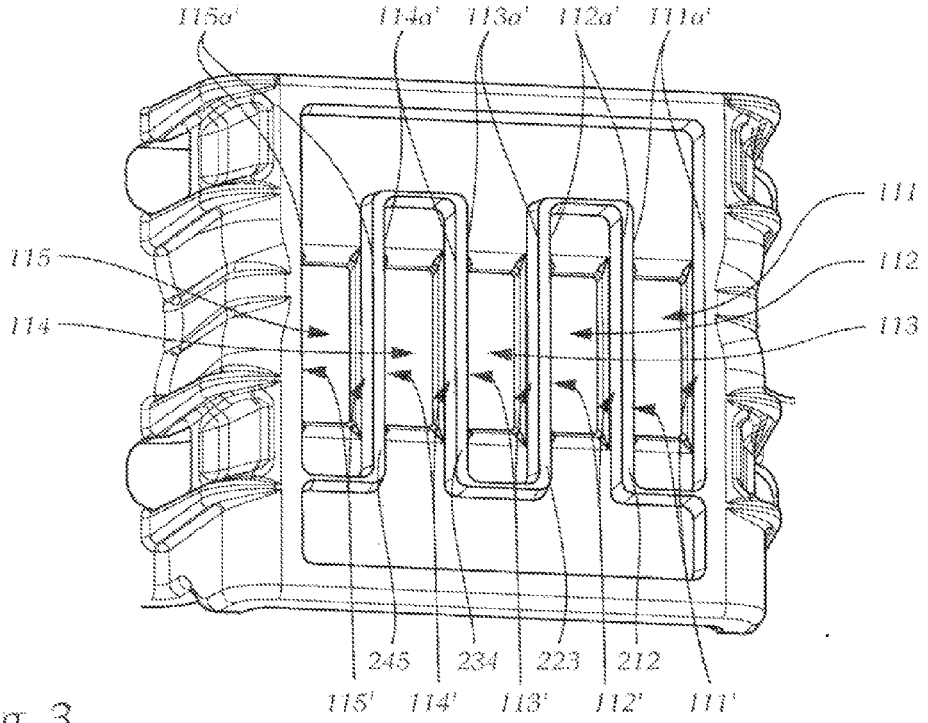

The invention will be explained in greater detail hereinafter on the basis of the drawing, in which FIG. 1 shows a perspective schematic illustration of a lighting device according to the invention in the form of a light module in a perspective view obliquely from the front, FIG. 2 shows the light source support, mounting device and optical body of the light module from FIG. 1 in an exploded illustration, FIG. 3 shows a detail of the main body of the mounting device from FIG. 2 in a perspective view from the front in the region of the receptacles for the ancillary optics of the optical body, FIG. 4 shows the light module from FIG. 1 in a view from above, FIG. 5 shows the light module from FIG. 1 in a vertical section in or parallel to the optical axis of the light module, and FIG. 6 shows a section corresponding to FIG. 5 for a light module known from the prior art.

FIG. 1 shows a lighting device 500 according to the invention in the form of a light module. The light module comprises a support 200 for a plurality of light sources, for example LED light sources. The light module 500 also comprises an optical body 1, which is held on the support 200 by a mounting device 100. Lastly, a projection lens 501 having a focal point F1 is also illustrated. The light entering the optical body from the light source is projected by the projection lens into a region in front of the vehicle, in which the illustrated light module is installed.

FIG. 2 shows, by way of example and in an exploded illustration, a mounting device 100 for the optical body 1. The optical body 1 comprises a number of ancillary optics 11, 12, 13, 14, 15 arranged adjacently side by side, wherein each ancillary optics 11-15 is formed from a light-guiding material and each ancillary optics 11-15 has a light-coupling face 11*a*-15*a* and a light-decoupling face 11*b*-15*b*.

The light-decoupling faces 11*b*-15*b* of adjacent ancillary optics 11-15 here are arranged at a distance a>0 from one another, and, as illustrated, adjacent ancillary optics are generally distanced from one another over their entire extent and not only in the region of the light-decoupling faces in order to prevent a passing of light from one ancillary optics into an adjacent ancillary optics.

The ancillary optics 11-15 are mechanically interconnected in the region of the light-decoupling faces 11*b*-15*b* by two connecting webs 21, 22 extending transversely to the ancillary optics 11-15. These connecting webs 21, 22 are usually optically ineffective here, at least in regions. The connecting webs 21, 22 are disposed here in the installed position of the optical body (i.e. of the light module or headlight containing the optical body in question) one in an upper and one in a lower region of the optical element 1.

The optical body or the optical element 1 can be manufactured from one piece. For manufacturing reasons, however, it may be particularly advantageous if the optical body 1 consists as shown of two separate optical components 1*a*, 1*b*, wherein each optical component 1*a*, 1*b* comprises two or more ancillary optics 11, 13, 15; 12, 14 (in the specific example two and three ancillary optics).

It should be noted at this juncture that the invention is not limited to an optical body as illustrated in the figure, although the use of an optical body of this type is preferred. Instead, the invention also extends by way of example to a one-part optical body, and also to optical bodies, in which the ancillary optics are not mechanically interconnected by means of one or more transverse webs.

The mounting device 100 in the shown example has a main body 101 and a retaining body 102, which, following the introduction of the optical body 1 into the main body 101, can be applied to the main body 101 in the direction of introduction of the optical body 1 (i.e. substantially against the light exit direction) and can be fastened thereto. A fastening device 101*a*, 102*a* is also provided, by means of which the retaining body 102 can be fixed to the main body 101.

In the shown example the fastening device comprises detent elements 102*a* and corresponding detent recesses 101*a*, wherein the detent elements 102*a* are arranged on the retaining body 102 and the corresponding detent recesses 101*a* are arranged on the main body 101. The main body and retaining body can in this way be connected to one another in a stable manner, such that the ancillary optics is also held in a stable manner in the desired position.

As can be inferred from FIG. 2, the retaining body 102 here has an opening 102', such that light can exit unhindered from the light-decoupling faces 11*b*-15*b* of the ancillary optics 11-15.

The retaining body 102 has clamping elements 102*b* which, when the retaining body 102 is fastened to the main body 101, come to rest against the connecting webs 21, 22 on the front faces thereof and press the optical body 1 via the transverse webs 21, 22 thereof against stops 121, 122 in the main body 101.

Furthermore, the retaining body 102 has clamping elements 102*c*, which, when the retaining body 102 is fastened to the main body 101, come to rest against one or more light-decoupling faces or preferably, as shown, in a region of the light-decoupling faces 11*b*-15*b* of the ancillary optics 11-15.

The clamping elements 102*b*, 102*c* press the optical body 1 against the stop regions 121, 122 of the main body 101, for which purpose the clamping elements 102*b*, 102*c* are preferably resilient, in particular spring-loaded.

The optical body 1 can already be secured in the above-described way against a lateral displacement, i.e. to the left/right or upwardly/downwardly, or the main body 101 is formed accordingly, such that a displacement of this type is prevented. By way of example, a displacement of this type can be prevented by the receptacles described below and/or by walls delimiting the stops 121, 122 on all sides.

As can be inferred from FIGS. 2 and 3, the mounting device 100, specifically the main body 101, has at least one receptacle 111, 112, 113, 114, 115 for each ancillary optics 11-15. These receptacles 111-115 are delimited by delimiting walls 111', 112', 113', 114' 115', wherein the delimiting walls 111', 112', 113', 114', 115' have boundary edges 111*a*', 112*a*', 113*a*', 114*a*', 115*a'* on the light exit side.

Adjacently arranged receptacles 111, 112; 112, 113; 113, 114; 114, 115 are separated here in the specific example in each case by a common separation web 212, 223, 234, 245, which webs form the delimiting walls 111', 112', 113', 114', 115' for the adjacently arranged receptacles 111-115.

The delimiting walls are formed from a light-impermeable material (usually the entire main body is formed from a single light-impermeable material, often in one piece), and therefore the boundary edges 111*a*', 112*a*', 113*a*', 114*a*', 115*a'* are imaged in a light distribution produced by means of the optical body 1 as vertically extending light-dark edges between the partial light distributions produced by the individual ancillary optics 11-15.

The ancillary optics 11-15 preferably bear directly, i.e. with no distance, against the delimiting walls 111', 112', 113', 114', 115' of their receptacle 111-115 so as to obtain an optimal optical display of the light segments.

Delimiting walls 111', 112', 113', 114', 115' and therefore boundary edges 111*a*', 112*a*', 113*a*', 114*a*', 115*a'* are provided here at least between the adjacently arranged receptacles, however it is preferable if the two outer receptacles 111, 115 are each also delimited on their outer side by delimiting walls 111', 115'.

As can be inferred from FIG. 2, the light-decoupling faces 11*b*-15*b* of the ancillary optics 11-15 are flat in the shown example and lie in a common plane E2 (see FIGS. 4 and 5).

The boundary edges 111*a*', 112*a*', 113*a*', 114*a*', 115*a'* likewise lie in a common plane E1. In the case of an optics body 1' according to the prior art, as illustrated in FIG. 6, these two planes E1, E2 coincide, and the focal point F1 of the projection lens F1 also lies in this common plane. Strictly speaking, this might not be a focal point exactly, but instead a focal line, wherein in the latter case this focal line contacts the plane E1, E2.

In accordance with the invention the ancillary optics 11-15 are now arranged and/or configured in such a way that the light-decoupling faces 11*b*-15*b* of the ancillary optics 11-15 protrude in the light exit direction beyond the boundary edges 111*a*', 112*a*', 113*a*', 114*a*', 115*a'* of the boundary walls 111', 112', 113', 114', 115', as can be clearly seen in FIGS. 4 and 5. The plane E2, in which the light-decoupling faces lie, is thus disposed closer to the projection lens 501 than the plane E1 of the boundary edges.

The focal point F1 (or the focal line) of the projection lens 501 still lies, however, in the plane E1 of the boundary edges, and therefore these boundary edges are sharply imaged in the light pattern, and the light segments are therefore sharply delimited.

Due to the protruding arrangement of the light-decoupling faces with respect to the boundary edges, the boundary edges, which are still arranged in a plane containing the focal point of the downstream projection lens, are still imaged sharply, whereas the light-decoupling faces are imaged in a defocussed manner and accordingly are imaged in a blurred manner. For the light distribution within the individual light segments, this blurred imaging is irrelevant, since a homogeneous light distribution is what matters here, whereas the delimitation of the light segments is still imaged sharply. Due to the defocussing of the light-decoupling faces, however, any dust deposits are also imaged in a defocussed manner and accordingly can no longer be identified and no longer disturb the homogeneity of the light distribution.

The two planes E1, E2 are preferably parallel to one another, as shown.

The invention claimed is:

1. A lighting device (500) for a motor vehicle headlight, the lighting device comprising:

at least one optical body (1);

at least one mounting device (100) for the at least one optical body (1); and a projection lens (501) arranged downstream of the at least one optical body (1) in the light exit direction, wherein the at least one optical body (1) has a number of adjacently arranged ancillary optics (11, 12, 13, 14, 15), wherein each ancillary optics (11-15) is formed from a light-guiding material and each ancillary optics (11-15) has a light-coupling face (11*a*-15*a*) and a light-decoupling face (11*b*-15*b*), wherein the at least one mounting device (100) has at least one receptacle (111, 112, 113, 114, 115) for each ancillary optics (11-15), and wherein receptacles (111-115) are delimited by delimiting walls (111', 112', 113', 114', 115'), wherein the delimiting walls (111', 112', 113', 114', 115') are formed from a light-impermeable material and have boundary edges (111*a*', 112*a*', 113*a*', 114*a*', 115*a*') on the light exit side, wherein the light exit-side boundary edges (111*a*', 112*a*', 113*a*', 114*a*', 115*a*') of the delimiting walls (111', 112', 113', 114', 115') lie in a common plane (E1) and a focal point (F1) of the projection lens (501) lies in this common plane (E1), such that the boundary edges (111*a*', 112*a*', 113*a*', 114*a*', 115*a*') are imaged, in a light distribution produced by means of the at least one optical body (1), as light-dark edges between the partial light distributions produced by the individual ancillary optics (11-15), and wherein the ancillary optics (11-15) are arranged and/or configured in such a way that the light-decoupling faces (11*b*-15*b*) of the ancillary optics (11-15) protrude in the light exit direction beyond the boundary edges (111*a*', 112*a*', 113*a*', 114*a*', 115*a*') of the delimiting walls (111', 112', 113', 114', 115').

2. The lighting device according to claim 1, characterised in that the boundary edges (111*a*', 112*a*', 113*a*', 114*a*', 115*a*') lie in a common plane (E1).

3. The lighting device according to claim 2, characterised in that the common plane (E1) of the boundary edges (111*a*', 112*a*', 113*a*', 114*a*', 115*a*') is flat and is preferably arranged approximately normal to the light exit direction.

4. The lighting device according to any one of claims 1 to 3, characterised in that the light-decoupling faces (11*b*-15*b*) of the ancillary optics (11-15) are flat.

5. The lighting device according to claim 4, characterised in that the light-decoupling faces (11*b*-15*b*) of the ancillary optics (11-15) lie in a common plane (E2).

6. The lighting device according to claim 5, characterised in that the common plane of the light-decoupling faces (11*b*-15*b*) is arranged at a constant distance from the common plane of the boundary edges (111*a*', 112*a*', 113*a*', 114*a*', 115*a*').

7. The lighting device according to any one of claims 2 to 6, characterised in that the common plane (E1) of the boundary edges (111*a*', 112*a*', 113*a*', 114*a*', 115*a*') lies in a focal point (F1) of the projection lens (501) or contains this.

8. The lighting device according to any one of claims 1 to 7, characterised in that the ancillary optics (11-15) bear directly, i.e. with no distance, against the delimiting walls (111', 112', 113', 114', 115') of their at least one receptacle (111-115).

9. The lighting device according to any one of claims 1 to 8, characterised in that delimiting walls (111', 112', 113', 114', 115') are provided at least between the adjacently arranged receptacles.

10. The lighting device according to claim 9, characterised in that the two outer receptacles (111, 115) are also each delimited on their outer side by delimiting walls (111', 115').

11. The lighting device according to claim 9 or 10, characterised in that adjacently arranged receptacles (111, 112; 112, 113; 113, 114; 114, 115) are each separated by a common separation web (212, 223, 234, 245), which webs form the delimiting walls (111', 112', 113', 114', 115') for the adjacent receptacles (111-115).

12. The lighting device according to any one of claims 1 to 11, characterised in that the mounting device (100) can be connected to a support (200) for one or more light sources (2), which are provided to radiate light into the ancillary optics (11-15) of the optical body (1).

13. The lighting device according to claim 12, characterised in that the position of the boundary edges (111*a*', 112*a*', 113*a*', 114*a*', 115*a*') relative to the at least one light source (2) is fixed, and the optical body (1) is lengthened in the light exit direction compared with an optical body (1') of which the light exit faces lie in a common plane (E1) with the boundary edges.

14. The lighting device according to any one of claims 1 to 13, characterised in that the mounting device (100) comprises a main body (101), which can be connected to the support (200) for the one or more light sources (2) for feeding light into the optical body (1).

15. The lighting device according to claim 14, characterised in that the receptacles (111, 112, 113, 114, 115) for the ancillary optics (11-15) are formed in the main body (101).

16. The lighting device according to claim 15, characterised in that the ancillary optics (11-15) are mechanically interconnected in the region of the light-decoupling faces (11*b*-15*b*) by means of at least one connecting web (21, 22) extending transversely to the ancillary optics (11-15), wherein the at least one connecting web (21, 22) is optically ineffective at least in regions, and wherein the main body (101) also has at least one stop region (121, 122), against which the optical body (1) can be brought into abutment via a rear face (21', 22') of the at least one connecting web (21, 22) when the ancillary optics (11-15) are inserted into the at least one receptacle (111, 112, 113, 114, 115).

17. The lighting device according to any one of claims 1 to 16, characterised in that the light-decoupling faces (11*b*-15*b*) of adjacent ancillary optics (11-15) are arranged at a distance a>0 from one another.

18. The lighting device according to any one of claims 1 to 17, characterised in that the optical element (1) consists of at least two separate optical components (1*a*, 1*b*), wherein each optical component (1*a*, 1*b*) comprises at least one light-guiding body (11, 13, 15; 12, 14).

19. The lighting device according to claim 18, characterised in that the optical element (1*a*, 1*b*) consists of precisely two optical components (1*a*, 1*b*).

20. The lighting device according to any one of claims 1 to 19, characterised in that at least one, preferably all optical components (1*a*, 1*b*) comprises/comprise two or more light-guiding bodies (11, 13, 15; 12, 14).

* * * * *